US008770947B2

(12) United States Patent
Arnold

(10) Patent No.: US 8,770,947 B2
(45) Date of Patent: Jul. 8, 2014

(54) PUMPING DEVICE

(75) Inventor: Jacob Arnold, Enschede (NL)

(73) Assignee: Nijhuis Pompen B.V., Winterswijk (NE)

( * ) Notice: Subject to any disclaimer, the term of this patent is extended or adjusted under 35 U.S.C. 154(b) by 151 days.

(21) Appl. No.: 13/249,651

(22) Filed: Sep. 30, 2011

(65) Prior Publication Data

US 2012/0080108 A1 Apr. 5, 2012

(30) Foreign Application Priority Data

Sep. 30, 2010 (NL) ..... 2005425

(51) Int. Cl.

| | |
|---|---|
| ***F04B 23/14*** | (2006.01) |
| ***F04B 9/06*** | (2006.01) |
| ***F04F 10/02*** | (2006.01) |
| ***F16L 43/00*** | (2006.01) |

(52) U.S. Cl.

USPC ..... 417/199.1; 417/390; 137/147

(58) Field of Classification Search

USPC ..... 417/199.1, 390, 424.1, 424.2; 137/147, 137/149, 215, 565.01, 565.11

See application file for complete search history.

(56) References Cited

U.S. PATENT DOCUMENTS

| | | | | |
|---|---|---|---|---|
| 1,964,034 | A * | 6/1934 | Cook | 417/36 |
| 5,833,929 | A * | 11/1998 | Watson et al. | 422/123 |
| 2004/0156721 | A1 | 8/2004 | Olbert | |

FOREIGN PATENT DOCUMENTS

| | | |
|---|---|---|
| GB | 787259 | 12/1957 |
| GB | 787529 | * 12/1957 |
| JP | 8296579 | 11/1996 |
| WO | WO 2006136868 | 12/2006 |

OTHER PUBLICATIONS

European Search Report and the Written Opinion of the European Patent Office in counterpart foreign application Dutch Patent Application 2005425, filed Sep. 30, 2010.

* cited by examiner

*Primary Examiner* — Bryan Lettman

(74) *Attorney, Agent, or Firm* — Steven M. Koehler; Westman, Champlin & Koehler, P.A.

(57) ABSTRACT

A pumping device for pumping a liquid to a higher level comprises a pump having an inlet and an outlet, an inlet tube being located upstream of the inlet for guiding the fluid to the inlet, a siphon being located downstream of the outlet and an outlet tube being located downstream of the siphon for guiding the liquid from the outlet to the outlet tube via the siphon. The outlet tube extends at least beyond a front side of the pump as seen from the pump. With respect to the outlet tube the siphon extends at least partly at the opposite side of the front side.

18 Claims, 4 Drawing Sheets

PUMPING DEVICE

BACKGROUND

The discussion below is merely provided for general background information and is not intended to be used as an aid in determining the scope of the invention and/or the claimed subject matter.

Aspects of the present invention relate to a pumping device for pumping a liquid to a higher level, comprising a pump having an inlet and an outlet, an inlet tube being located upstream of the inlet for guiding the fluid to the inlet, a siphon being located downstream of the outlet and an outlet tube being located downstream of the siphon for guiding the liquid coming from the outlet to the outlet tube via the siphon, wherein the outlet tube extends at least beyond a front side of the pump as seen from the pump.

Such a pumping device is known and is applied in pumping plants, for example. Applying a siphon avoids that liquid flows back in reverse direction from a high level via the outlet tube to a low level via the inlet tube when the liquid level increases at the side of the high level. The height difference between the outlet tube and the summit of the siphon is often defined in regulations.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the pumping device herein described includes, with respect to an outlet tube, a siphon extends at least partly at an opposite side of said front side.

The pumping device provides the possibility to reduce the construction length of the pumping device with respect to conventional pumping devices in which the pump, the siphon and the outlet tube, respectively, are aligned as seen from above. The length of the novel pumping device can be minimized since the pump, the siphon and the outlet tube are not or not entirely located aligned in this sequence. In other words, the siphon is not necessarily located or not necessarily located entirely between the pump and the outlet tube as seen from the pump to the outlet tube.

The siphon comprises an ascending and a descending tube and may have several dimensions and shapes. The siphon may transfer into the outlet tube directly, but it is also possible that additional piping is present therein between. Furthermore, it is conceivable that the outlet tube already starts behind the front side of the pump and then extends along the pump beyond the front side thereof.

In a practical embodiment the outlet tube and the siphon are located at different sides of the pump, and in a more specific embodiment the siphon and the outlet tube are located at opposite sides of the pump.

In one embodiment the siphon is located above the inlet tube since in this case the space above the inlet tube is used efficiently. If the inlet tube and the outlet tube are aligned in longitudinal direction of the pumping device as seen from above, and the siphon is located above the inlet tube and opposite to the outlet tube with respect to the pump, the space taken up by the pumping device is used very efficiently.

The outlet of the pump may be located above its inlet.

Furthermore, the outlet of the pump may be located at the same side of the pump as the inlet tube. This leads to a reversed flow direction caused by the pump itself and avoids additional bends.

In a practical embodiment the pump is a vertically-oriented pump having an axis of rotation extending upwardly.

The outlet tube may be bifurcated at the pump in at least two tube portions which are located at either side of the pump. This leads to efficient use of space at both sides of the pump. However, it is also possible that the outlet tube is not divided and is guided along the pump at only one side of the pump.

In practice, the flow directions in the inlet tube and the outlet tube are substantially the same under operating conditions, that is to say in longitudinal direction of the pumping device.

The inlet tube and the outlet tube may be lying tubes, preferably extending horizontally. Furthermore, the outlet tube will be located at a higher level than the inlet tube.

BRIEF DESCRIPTION OF THE DRAWINGS

Aspects of the invention will hereafter be elucidated with reference to drawings showing an embodiment of the invention very schematically.

DETAILED DESCRIPTION OF THE ILLUSTRATIVE EMBODIMENTS

Figure 1:
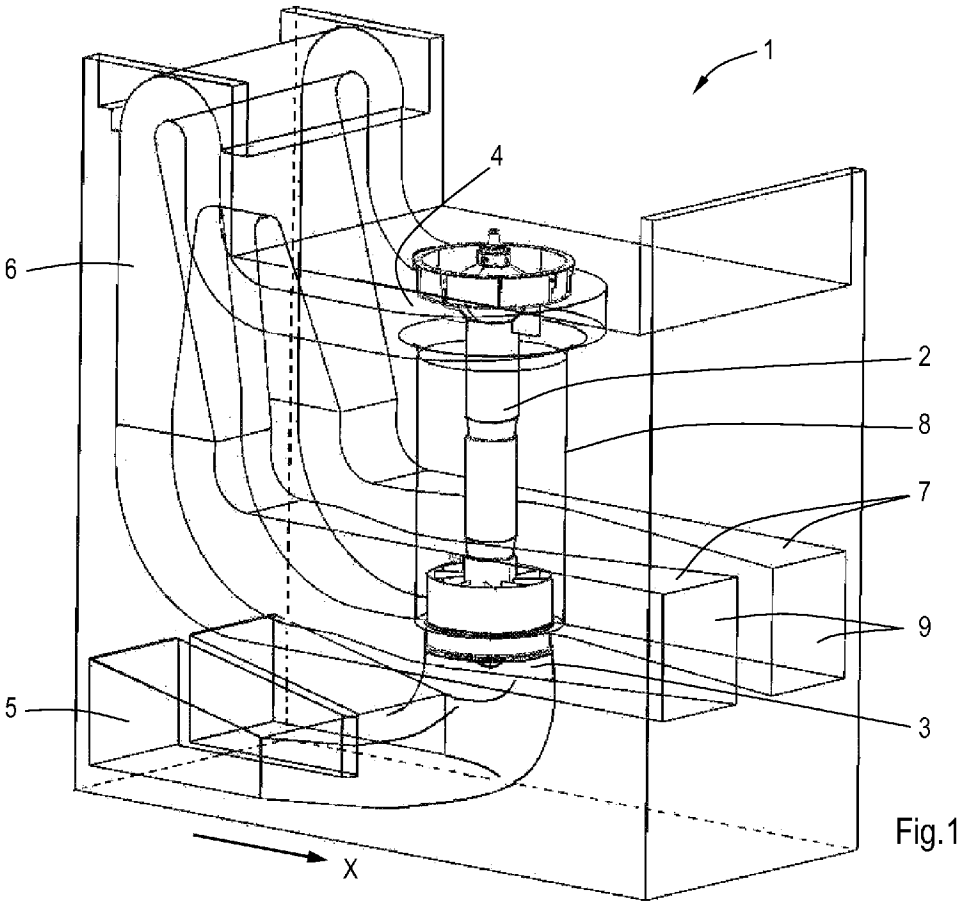
FIG. 1 is a cut-away view of an embodiment of the pumping device.

FIG. 1 shows an embodiment of a pumping device 1. The pumping device 1 is intended for pumping water from a low to a high level and is suitable for use in a pumping plant. Nevertheless, the pumping device 1 can also be applied in other fields where a liquid has to be pumped to a higher level.

Figure 4:
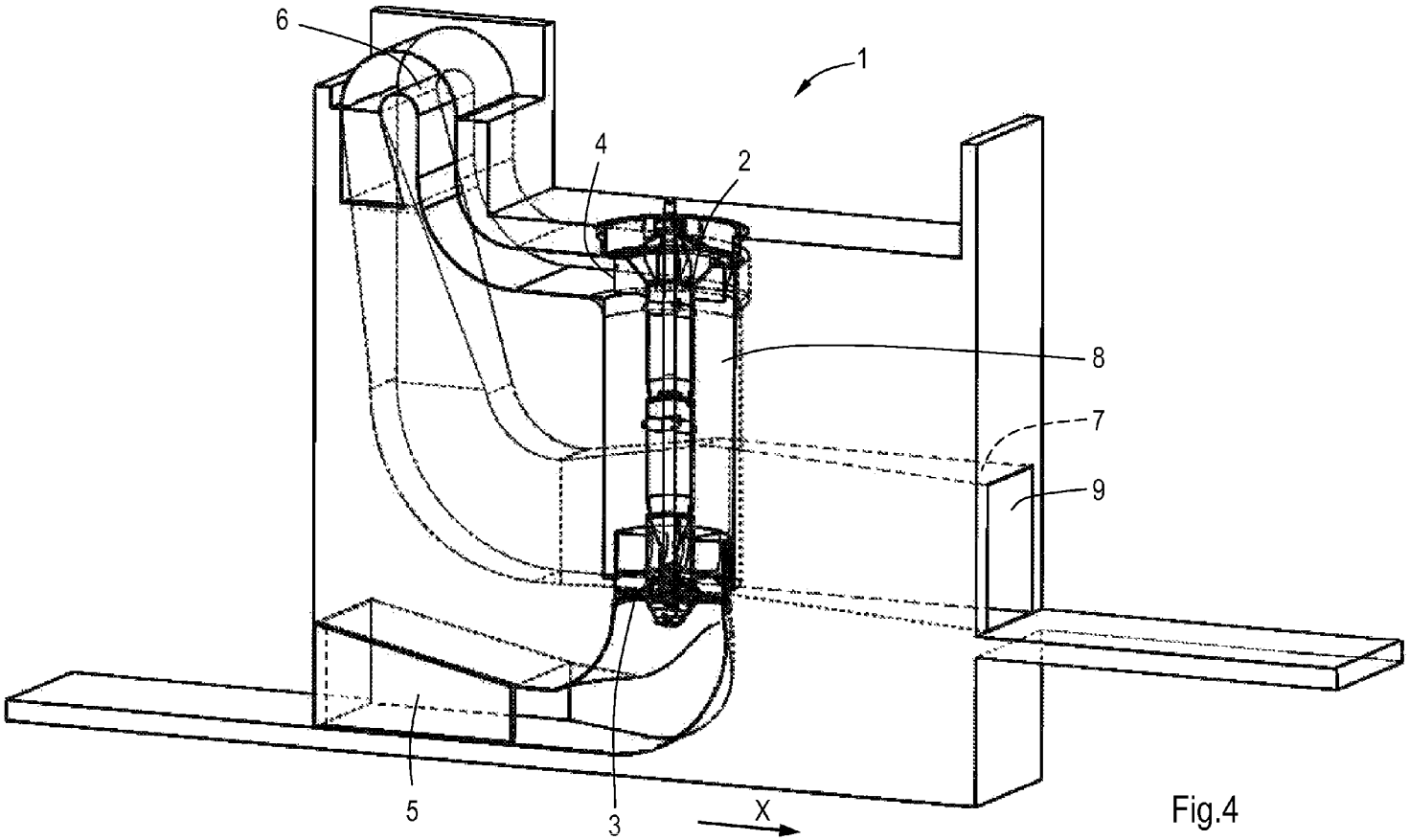
FIG. 4 is a similar view as FIG. 1 on a smaller scale of an alternative embodiment of the pumping device.

The pumping device 1 comprises a pump 2 having an inlet 3 and an outlet 4. The outlet 4 of the pump 2 is located above the inlet 3. In this case the pump 2 is of a type that is vertically-oriented having an axis of rotation which extends upwardly, but may be of a different type. At the inlet 3 the liquid flows upwardly in axial direction of the pump 2 under operating conditions. A lying inlet tube 5 is located upstream of the inlet 3 and a siphon 6 is located downstream of the outlet 4, which siphon 6 ends up in two outlet tubes 7 which are located downstream. In this embodiment there are two outlet tubes 7 at the pump 2 due to a bifurcation, but in an alternative embodiment such a bifurcation may be omitted, see FIG. 4.

Both outlet tubes 7 according to the embodiment as shown in FIG. 1 are located at either side of the pump 2. Furthermore, the outlet tubes 7 are aligned with respect to the inlet tube 5 as seen from above. The flow directions in the outlet tubes 7 and the inlet tube 5 are in longitudinal direction X of the pumping device 1, as shown in FIG. 1.

Under operating conditions water flows via the inlet tube 5 to the inlet 3 of the pump 2, after which the water flows out of the pump 2 at the outlet 4. Subsequently, the water is guided to the outlet tubes 7 via the siphon 6. In practice, the outlet tubes 7 end up in a reservoir where the water level is higher than the reservoir where the inlet tube 5 ends up. When the water level at the outlet tube 7 rises, the siphon 6 avoids reverse flow.

In this embodiment the outlet tubes 7 extend beyond a front side 8 of the pump 2 as seen from the pump 2, whereas the siphon 6 extends behind this front side 8. More specifically, the outlet tubes 7 are located at one side of the pump 2, whereas the siphon 6 is located at the opposite side of the pump 2. As seen from above the pump 2 is located between the siphon 6 and outlet openings 9 of the outlet tubes 7 in longitudinal direction X. In other words, as seen from above the siphon 6 and the outlet tubes 7 are angled by substantially 180° with respect to the pump 2.

As a consequence, in longitudinal direction X a more compact unit is obtained than in case of conventional pumping devices in which the pump, the siphon and the outlet tube, respectively, are placed in series in this order as seen from above. The bend below the siphon 6 can be located directly below the siphon 6 instead of behind it. This also provides the possibility to select a wide bend towards the lying outlet tubes 7 without increasing the construction length.

In the embodiment as shown in FIG. 1 the siphon 6 is located above the inlet tube 5. The outlet tubes 7 are located at a higher level than the inlet tube 5. The space above the inlet tube 5 can be used efficiently by the siphon 6 and provides the possibility for a gradual and, from point of view of flow dynamics, advantageous transfer of the siphon 6 into the outlet tubes 7.

Since the outlet 4 of the pump 2 is located at the same side of the pump 2 as the inlet tube 5 in the embodiment as shown, the flow direction of the water in the inlet tube 5 is reversed in the direction of the siphon 6 under operating conditions, such that additional bends are not necessary.

Figure 2:
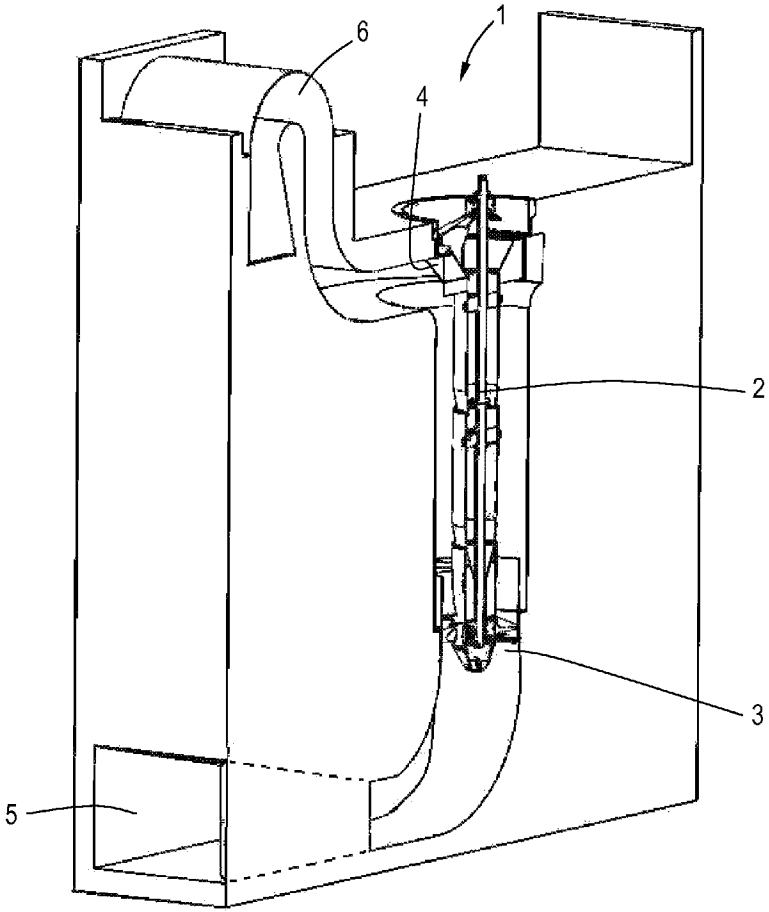
FIG. 2 is a partly cut-away perspective view of the embodiment according to FIG. 1, as seen from a different direction and on a smaller scale.
Figure 3:
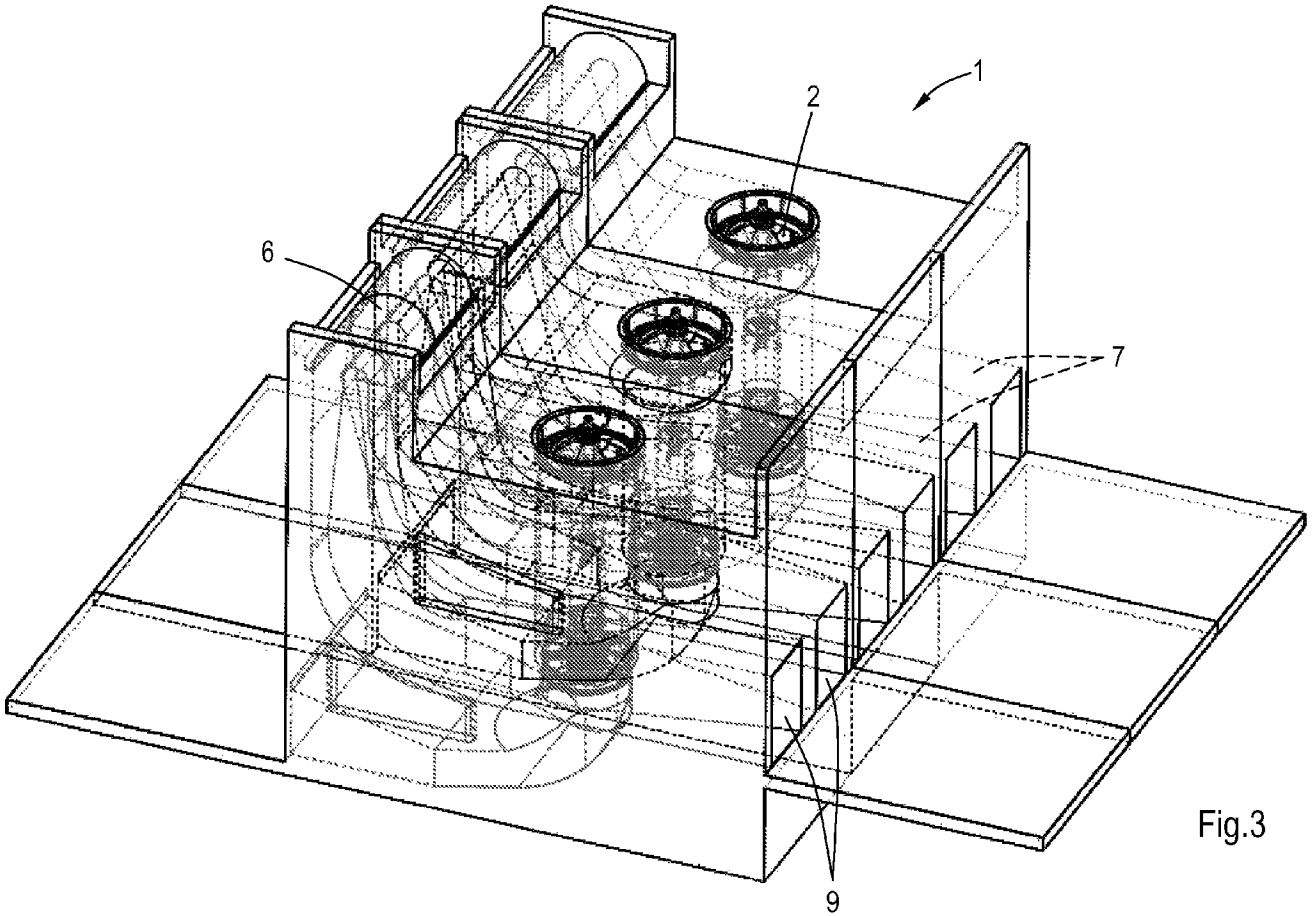
FIG. 3 is a cut-away perspective plan view of three embodiments according to FIGS. 1 and 2, placed in series.

FIG. 2 shows a partly cut-away perspective view of the embodiment as described hereinbefore. FIG. 3 shows a series of three units of the pumping device 1 which are located next to each other.

From the foregoing it will be clear that an aspect of the pumping device provides a compact unit.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims. For example, it is possible that the siphon and/or the inlet tube next to the pump is located laterally to the pump with respect to the longitudinal direction of the pumping device, such that the siphon/inlet tube and the outlet tube are angled by an angle which is smaller than 180° with respect to the pump.

The invention claimed is:

1. A pumping device for pumping a liquid to a higher level, comprising a pump having an inlet and an outlet, an inlet tube being located upstream of the inlet for guiding the fluid to the inlet, a siphon being located downstream of the outlet and an outlet tube being located downstream of the siphon for guiding the liquid from the outlet to the outlet tube via the siphon, wherein the outlet tube extends at least beyond a front side of the pumping device as seen from the pump, wherein with respect to the outlet tube the siphon extends at least partly at an opposite side of said front side; and wherein the outlet tube and the siphon are located at different sides of the pump.

2. The pumping device according to claim 1, wherein the siphon is located above the inlet tube.

3. The pumping device according to claim 1, wherein the outlet of the pump is located above its inlet.

4. The pumping device according to claim 1, wherein the outlet of the pump is located at a same side of the pump as the inlet tube.

5. The pumping device according to claim 1, wherein the pump is a vertically-oriented pump having an axis of rotation extending upwardly.

6. The pumping device according to claim 1, wherein at the pump the outlet tube is bifurcated in at least two tube portions which are located at either side of the pump.

7. The pumping device according to claim 1, wherein flow directions in the inlet tube and the outlet tube are substantially the same under operating conditions.

8. The pumping device according to claim 1, wherein the inlet tube and the outlet tube are lying tubes.

9. The pumping device according to claim 8 wherein the inlet tube and the outlet tube are lying tubes extending horizontally.

10. A pumping device for pumping a liquid to a higher level, comprising a pump having an inlet and an outlet, an inlet tube being located upstream of the inlet for guiding the fluid to the inlet, a siphon being located downstream of the outlet and an outlet tube being located downstream of the siphon for guiding the liquid from the outlet to the outlet tube via the siphon, wherein the outlet tube extends at least beyond a front side of the pumping device as seen from the pump, wherein with respect to the outlet tube the siphon extends at least partly at an opposite side of said front side, and wherein the siphon and the outlet tube are located at opposite sides of the pump.

11. The pumping device according to claim 10, wherein the siphon is located above the inlet tube.

12. The pumping device according to claim 10, wherein the outlet of the pump is located above its inlet.

13. The pumping device according to claim 10, wherein the outlet of the pump is located at a same side of the pump as the inlet tube.

14. The pumping device according to claim 10, wherein the pump is a vertically-oriented pump having an axis of rotation extending upwardly.

15. The pumping device according to claim 10, wherein at the pump the outlet tube is bifurcated in at least two tube portions which are located at either side of the pump.

16. The pumping device according to claim 10, wherein flow directions in the inlet tube and the outlet tube are substantially the same under operating conditions.

17. The pumping device according to claim 10, wherein the inlet tube and the outlet tube are lying tubes.

18. The pumping device according to claim 17 wherein the inlet tube and the outlet tube are lying tubes extending horizontally.

* * * * *